US008208639B2

(12) United States Patent
Nakagawa

(10) Patent No.: US 8,208,639 B2
(45) Date of Patent: Jun. 26, 2012

(54) AUDIO OUTPUT DEVICE AND AUDIO OUTPUT METHOD

(75) Inventor: Tooru Nakagawa, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/844,619

(22) Filed: Jul. 27, 2010

(65) Prior Publication Data

US 2011/0026717 A1 Feb. 3, 2011

(30) Foreign Application Priority Data

Jul. 30, 2009 (JP) ..... 2009-177780

(51) Int. Cl.
*H04R 5/00* (2006.01)
*H04R 5/02* (2006.01)

(52) U.S. Cl. ..... 381/1; 381/17; 381/18; 381/19; 381/27; 381/300; 381/381; 381/304; 381/301

(58) Field of Classification Search ..... 381/1, 17–19, 381/27, 123, 11, 300, 301, 304, 307
See application file for complete search history.

(56) References Cited

U.S. PATENT DOCUMENTS

| | | | | |
|---|---|---|---|---|
| 6,381,335 | B2 | 4/2002 | Juszkiewicz | |
| 7,813,824 | B2 | 10/2010 | Takahama | |
| 2001/0053231 | A1 | 12/2001 | Juszkiewicz | |
| 2002/0131611 | A1 * | 9/2002 | Hoover et al. | 381/123 |
| 2005/0157889 | A1 | 7/2005 | Yonezu | |
| 2007/0077020 | A1 | 4/2007 | Takahama | |
| 2008/0080730 | A1 | 4/2008 | Takakusaki | |
| 2011/0026728 | A1 | 2/2011 | Nakagawa | |

FOREIGN PATENT DOCUMENTS

| | | |
|---|---|---|
| JP | 6-085772 | 3/1994 |
| JP | 2001-084079 | 3/2001 |
| JP | 2001-309499 | 11/2001 |
| JP | 2003-009279 | 1/2003 |
| JP | 2003-518345 | 6/2003 |
| JP | 2004-023512 | 1/2004 |
| JP | 2004-363952 | 12/2004 |
| JP | 2006-311070 | 11/2006 |
| JP | 2006-339852 | 12/2006 |
| JP | 2007-060367 | 3/2007 |

(Continued)

OTHER PUBLICATIONS

Japanese Patent Application No. 2009-177780; Notification of Reasons for Refusal; Mailed Oct. 12, 2010 (English translation).

(Continued)

*Primary Examiner* — Devona Faulk
(74) *Attorney, Agent, or Firm* — Blakely, Sokoloff, Taylor & Zafman LLP

(57) ABSTRACT

An audio output device includes: a speaker unit including at least first to third speakers; and an audio signal processor configured to select either one of a first mode for outputting a stereo audio signal from the first and second speakers and a second mode for outputting a monaural audio signal from the third speaker and the first or second speaker.

10 Claims, 7 Drawing Sheets

FOREIGN PATENT DOCUMENTS

| | | |
|---|---|---|
| JP | 2007-088774 | 4/2007 |
| JP | 2008-085803 | 4/2008 |
| JP | 2008-085902 | 4/2008 |
| JP | 2008-109382 | 5/2008 |
| JP | 2008-154084 | 7/2008 |
| JP | 2009-055450 | 3/2009 |
| JP | 2009-089425 | 4/2009 |
| JP | 2009-105479 | 5/2009 |

OTHER PUBLICATIONS

Japanese Patent Application No. 2009-177781; Notification of Reasons for Refusal; mailed Sep. 21, 2010. (with English Translation).
U.S. Appl. No. 12/844,605; Non-Final Office Action; mailed Aug. 30, 2011.
U.S. Appl. No. 12/844,605, Final Office Action, mailed Dec. 19, 2011.

* cited by examiner

AUDIO OUTPUT DEVICE AND AUDIO OUTPUT METHOD

CROSS-REFERENCE TO RELATED APPLICATIONS

This application is based upon and claims the benefit of priority from Japanese Patent Application No. 2009-177780, filed Jul. 30, 2009, the entire contents of which are incorporated herein by reference.

BACKGROUND

1. Field

The present invention relates to an audio output device and method which is used as a center speaker system.

2. Description of the Related Art

As an audio output device according to the background art, there is an audio output device which reproduces audio by using speakers for achieving a high definition acoustic effect. It is disclosed by, for example, JP-T-2003-518345. In the audio output device, five speakers are disposed in the front center, front left, front right, rear left and rear right of a user (5-channel). In addition, a sub-woofer for enhancing bass is disposed (0.1-channel). When the aforementioned six speakers (5.1-channel) are disposed around an audience so that audio can be output from the speakers, three-dimensional audio can be provided with a high definition acoustic effect.

When the 5.1-channel audio output device is used in combination with an AV device such as a TV set, the positional relation between the speakers of the audio output device and speakers of the AV device however becomes an issue. Especially, the speaker (center speaker) disposed in the front center of the user need be disposed near a video display device such as a TV set disposed in front of the user in consideration of sound location. There is however a problem that the center speaker may be disposed to hide opening portions of speakers provided in the AV device such as a TV set when, for example, the speakers of the AV device are located on a lower side of the AV device. Moreover, there is a problem concerned with coexistence of the center speaker with the speakers provided in the AV device, for example, because there is a possibility that change of sound location will make it difficult to obtain sufficient sound localization particularly in the center when the center speaker is not disposed in the front center of the user.

BRIEF DESCRIPTION OF THE DRAWINGS

A general configuration that implements the various feature of the invention will be described with reference to the drawings. The drawings and the associated descriptions are provided to illustrate embodiments of the invention and not to limit the scope of the invention.

DETAILED DESCRIPTION OF THE EMBODIMENTS

An embodiment of the invention will be described below in detail with reference to the drawings.

Figure 1:
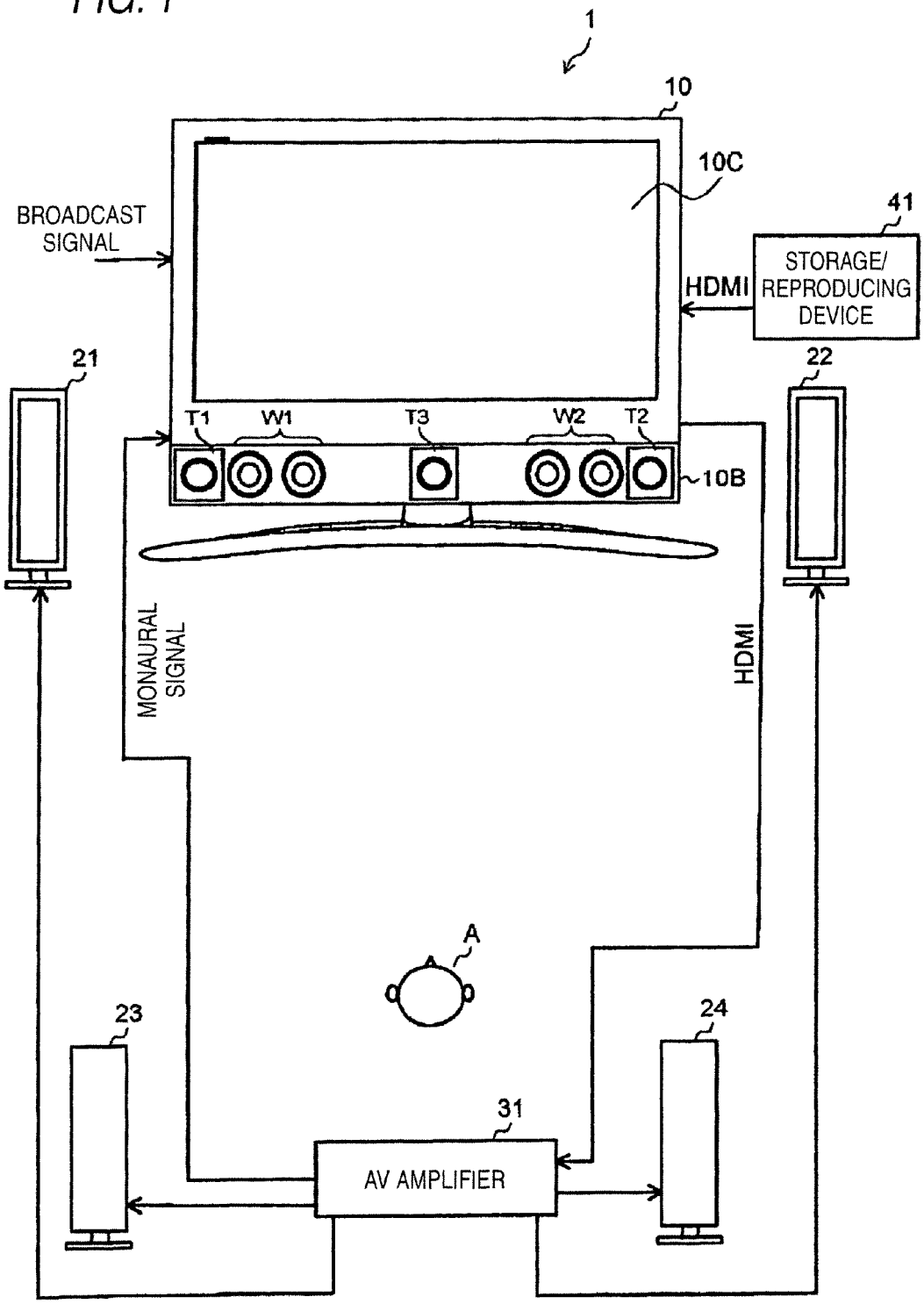
FIG. 1 is an exemplary view showing a configuration of an acoustic system according to a first embodiment.

FIG. 1 is an exemplary view showing a configuration of an acoustic system 1 according to a first embodiment. The acoustic system 1 according to the first embodiment includes an audio output device 10, speakers 21 to 24, an AV amplifier 31, and a storage/reproducing device 41.

The audio output device 10 includes an STB (Set Top Box) 10A (not shown), a speaker unit 10B, and a display unit 10C. The STB 10A generates a video signal and an audio signal by decoding a broadcast signal of a broadcast station etc. input through an antenna not shown. The STB 10A feeds the generated video and audio signals or video and audio signals input from an external storage/reproducing device (or a reproducing device) 41 to the speaker unit 10B and the display unit 10C respectively. In addition, the STB 10A feeds the audio signal to the AV amplifier 31. The display unit 10C displays video based on the video signal fed from the STB 10A.

The speaker unit 10B outputs audio based on the audio signal fed from the STB 10A or the AV amplifier 31. The speaker unit 10B is provided as a two-way speaker system having woofers W1 and W2 and tweeters T1 and T2 for reproducing stereo audio. A combination of the woofers W1 and the tweeter T1 and a combination of the woofers W2 and the tweeter T2 are disposed on left and right sides of an integrally formed speaker box, respectively. A tweeter T3 is disposed between the woofers W1 and W2. The tweeter T3 cooperates with the woofers W1 and W2 to serve as a center speaker. The tweeter T3 takes in charge of a treble range of an audio signal (center channel) used for the center speaker while the woofers W1 and W2 take in charge of a bass range of the center channel. Incidentally, each of the woofers W1 and W2 may be a full range speaker.

The speakers 21 to 24 are disposed in the front left, front right, rear left and rear right of a user A so as to surround the user A. The speakers 21 to 24 cooperate with the speakers (the tweeter T3 and the woofers W1 and W2) provided in the speaker unit 10B of the audio output device 10 to form a 5.1-channel acoustic system.

The AV amplifier 31 is connected to the audio output device 10 by an HDMI (High-Definition Multimedia Interface) and/or an audio digital transmission interface (SPDIF) using an optical or coaxial technique. Non-compressed digital video and audio signals are transmitted by the HDMI. The AV amplifier 31 amplifies an audio signal fed from the audio output device 10 and feeds the amplified signal to the speakers 21 to 24.

Incidentally, two types of outputs for the center speaker are prepared by the AV amplifier 31. One is a volume-controlled line output. The other is an output obtained by further amplifying the volume-controlled line output. In the first embodiment, the volume-controlled line output is input to the audio output device 10 so that the volume-controlled line output is output as audio from the speaker unit 10B serving as the center speaker.

The storage/reproducing device 41 is a DVD (Digital Versatile Disk) player or recorder, an HDD (Hard Disk Drive) recorder, etc. for storing/reproducing contents. The storage/reproducing device 41 is connected to the audio output device 10 by an HDMI. The storage/reproducing device 41 inputs a video signal, an audio signal and a control signal of contents (e.g. movie, PV (Promotion Video), etc.) to be reproduced, to the audio output device 10. In the HDMI, wiring can be simplified because a video signal cable, an audio signal cable and a control signal cable are integrated into one cable.

Figure 2:
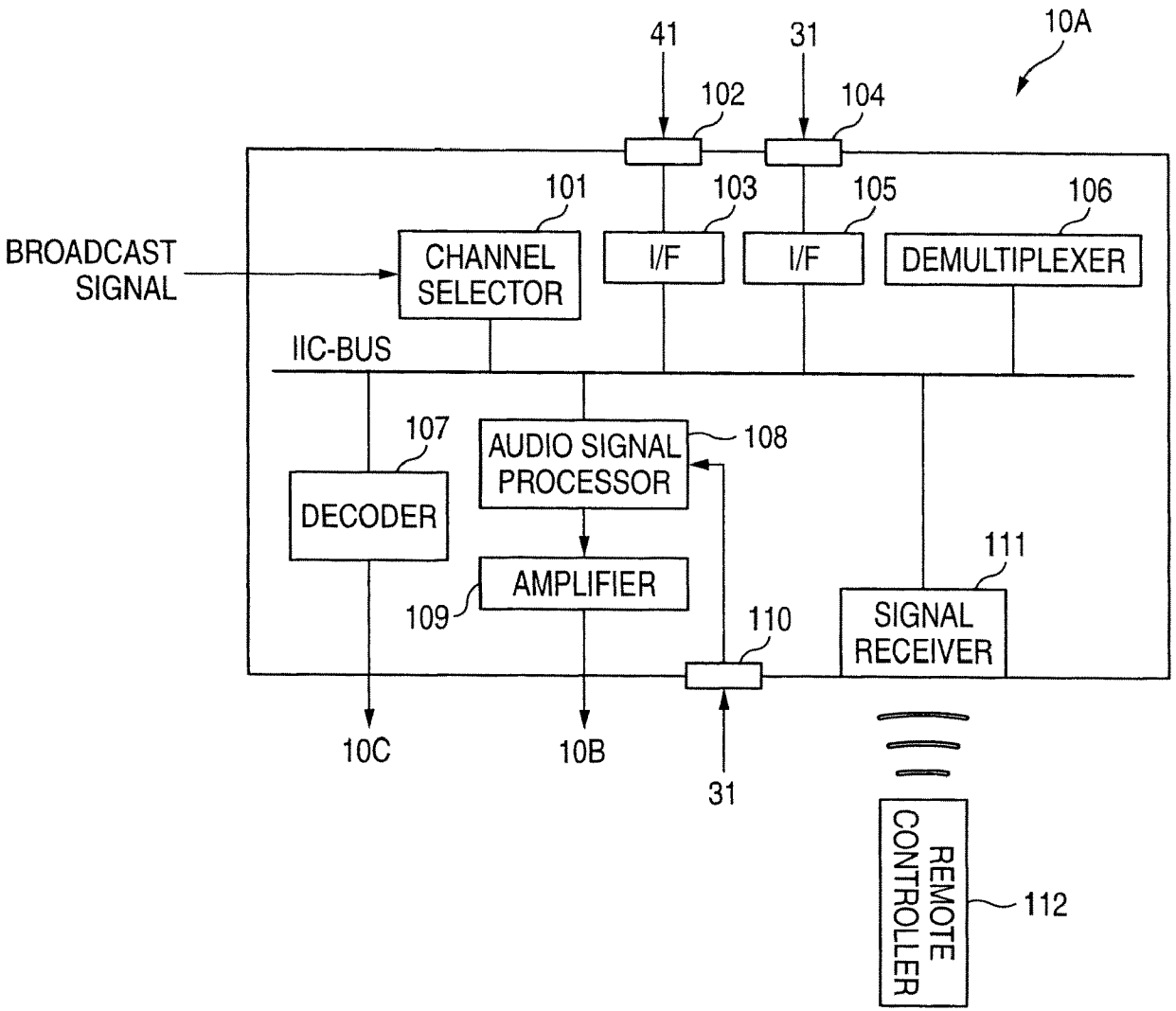
FIG. 2 is an exemplary diagram showing an outline of an STB.

FIG. 2 is an exemplary diagram showing the schematic configuration of an electronic circuit (STB 10A) of a device used in the first embodiment. The SIB 10A includes a channel selector 101, a terminal 102, an I/F 103, a terminal 104, an I/F 105, a demultiplexer 106, a decoder 107, an audio signal processor 108, an amplifier 109, a terminal 110, and a signal receiver 111.

The channel selector 101 selects a desired channel from a broadcast signal received via an antenna. The channel selector 101 generates a TS (Transport Stream) by demodulating the broadcast signal of the selected channel.

The terminal 102 is an HDMI terminal for connecting the storage/reproducing device 41. The I/F (Interface) 103 is an interface for receiving/transmitting data from/to the storage/reproducing device 41 connected to the terminal 102.

The terminal 104 is an HDMI terminal or an SPDIF terminal for connecting the AV amplifier 31. The I/F 105 is an interface for receiving/transmitting an audio signal (or audio data) and data from/to the AV amplifier 31 connected to the terminal 104.

The demultiplexer 106 demultiplexes a broadcast signal, SI/PSI, etc. from the TS generated by the channel selector 101. The TS is a multiplexed signal including a broadcast signal and SI/PSI. For example, the broadcast signal is an MPEG-2 broadcast signal. The broadcast signal contains an audio ES (Audio Elementary Stream) and a video ES (Video Elementary Stream) which are provided as coded audio and video respectively. The PSI is information for specifying programs present in the TS and specifying ESs contained in the TS and belonging to the programs respectively. The SI contains Electronic Program Guide (EPG) information.

The decoder 107 generates an audio signal and a video signal by decoding the audio and video ESs demultiplexed by the demultiplexer 106. The generated audio signal is output to the audio signal processor 108 and the AV amplifier 31 (via the terminal 104). The video signal is input to the display unit 10C. The display unit 10C displays video based on the video signal fed from the decoder 107 or the video signal fed from the storage/reproducing device 41 through the terminal 102.

A signal cable from the AV amplifier 31 is connected to the terminal 110. An audio signal (monaural audio signal) for the center speaker, output from the AV amplifier 31, is input to the audio signal processor 108.

The audio signal processor 108 is configured by a circuit such as a DSP (Digital Signal Processor), etc. When the AV amplifier 31 is used (when the AV amplifier 31 is turned on), the audio signal processor 108 inputs a monaural audio signal fed from the AV amplifier 31 to the tweeter T3 and the woofers W1 and W2. In this case, a combination of the tweeter T3 and the woofers W1 and W2 serves as a center speaker of a 5.1-channel acoustic system. On the other hand, when the AV amplifier 31 is not used, the audio signal processor 108 inputs an audio signal fed from the decoder 107 or from the storage/reproducing device 41 via the terminal 102 to the tweeters T1 and T2 and the woofers W1 and W2. The amplifier 109 amplifies the audio signal fed from the audio signal processor 108 and feeds the amplified audio signal to the speaker unit 10B.

Figure 3:
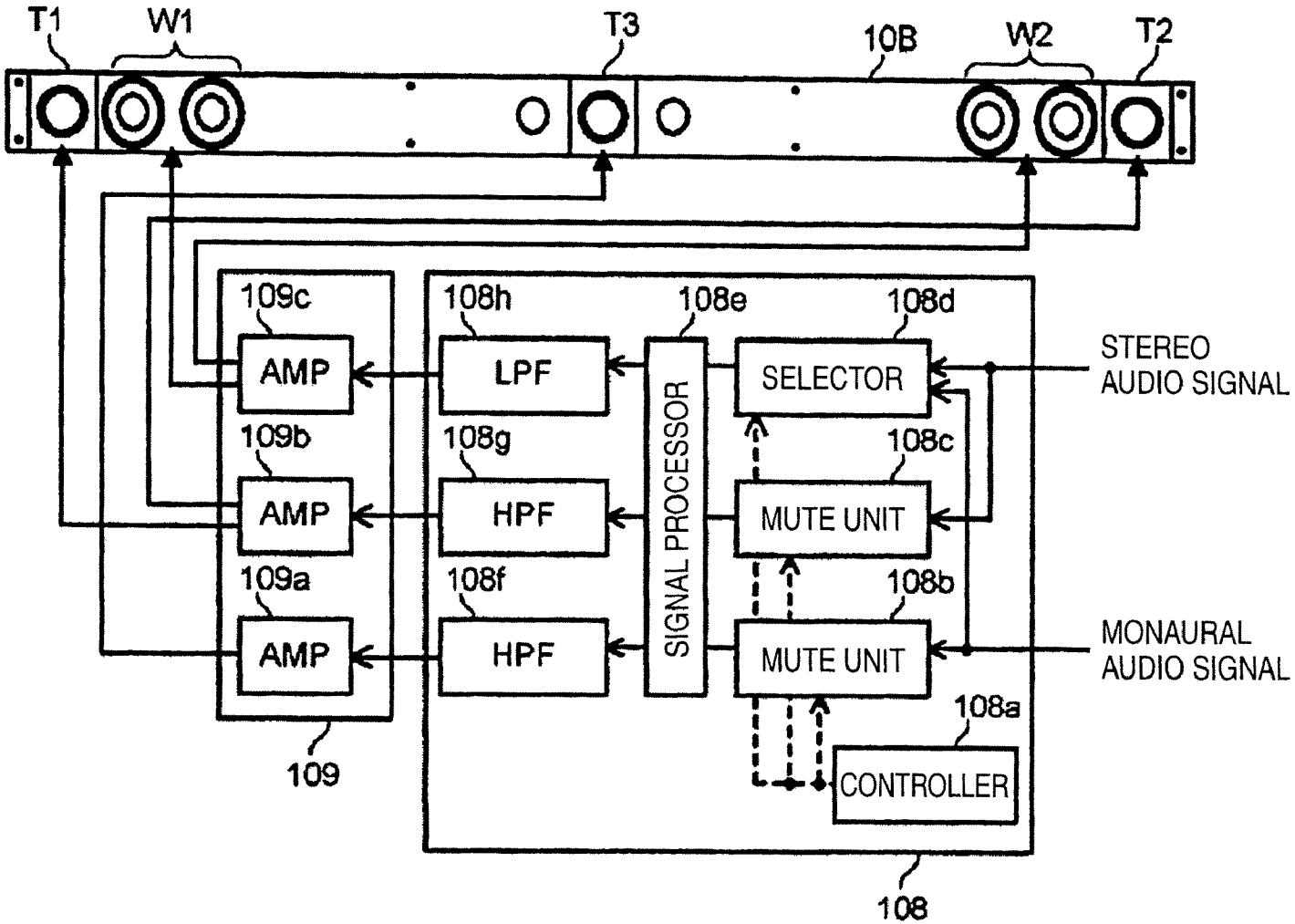
FIG. 3 is an exemplary diagram showing a configuration of an audio signal processing system according to the first embodiment.

FIG. 3 is an exemplary view showing the configuration of an audio signal processing system according to the first embodiment. The audio signal processor 108 includes a controller 108*a*, mute units 108*b* and 108*c*, a selector 108*d*, a signal processor 108*e*, HPFs (High Pass Filters) 108*f* and 108*g*, and an LPF Pass Filter) 108*h*. The amplifier 109 includes amplifiers 109*a* to 109*c*.

The mute unit 108*b* mutes an input monaural audio signal in accordance with an instruction given from the controller 108*a*. The mute unit 108*c* mutes an input stereo audio signal in accordance with an instruction given from the controller 108*a*. The selector 108*d* selects either of the input stereo audio signal and the input monaural audio signal in accordance with an instruction given from the controller 108*a*.

The signal processor 108*e* processes the input audio signal fed from the mute units 108*b* and 108*c* and the selector 108*d*. Specifically, the signal processor 108*e* performs processing such as volume control, sound quality setting (amplification/attenuation of bass/treble) and surround processing. Configuration may be made so that the signal processor 108*e* is inserted in a front stage of the mute units 108*b* and 108*c* and the selector 108*d*.

The HPF 108*f* passes a treble component (high frequency component) of the monaural audio signal fed from the signal processor 108*e* so that the treble component of the monaural audio signal is input to the AMP 109*a*. The HPF 108*g* passes a treble component of the stereo audio signal fed from the signal processor 108*e* so that the treble component of the stereo audio signal is input to the AMP 109*b*. The LPF 108*h* passes a bass component (low frequency component) of the stereo audio signal or monaural audio signal fed from the signal processor 108*e* so that the bass component of the audio signal is input to the AMP 109*c*.

The AMP 109*a* amplifies the monaural audio signal fed from the HPF 108*f* so that the amplified monaural audio signal is input to the tweeter T3. The AMP 109*b* amplifies the stereo audio signal fed from the HPF 108*g* so that the amplified stereo audio signal is input to the tweeters T1 and T2. The AMP 109*c* amplifies the stereo or monaural audio signal fed from the LPF 108*h* so that the amplified stereo or monaural audio signal is input to the woofers W1 and W2.

Each of the HPFs 108*f* and 108*g* and the LPF 108*h* is an FIR (Finite Impulse Response) type filter which can achieve such linear phase (constant delay) characteristic that could not but be achieved approximately by an analog filter. The linear phase is such characteristic that phase characteristic is linear with respect to any frequency. That is, because all frequency components are delayed for a constant time, an accurate waveform can be reproduced without any disturbance of the waveform. Accordingly, system adjustment can be made without taking phase delay into consideration in the filtering process. Results of comparison between the FIR type filter and the analog filter will be described later with reference to FIGS. 6A to 7C.

The controller 108*a* controls the mute units 108*b* and 108*c* and the selector 108*d* in accordance with whether the AV amplifier 31 is used or not. Whether the AV amplifier 31 is used or not, can be confirmed based on communication with the AV amplifier 31 by the HDMI. Incidentally, configuration may be made so that whether the AV amplifier 31 is used or not can be set by a remote controller 112 (which will be described later), and that whether the AV amplifier 31 is used or not can be confirmed based on the content of the setting.

When the AV amplifier 31 is not used, stereo audio may be output from the speaker unit 10B because the user makes external speakers not available. Therefore, the controller 108*a* controls the mute unit 108*b* to mute the monaural audio signal. The controller 108*a* further controls the selector 108*d* to select the stereo audio signal. By the aforementioned control, stereo audio is output from a combination of the woofers W1 and the tweeter T1 and a combination of the woofers W2 and the tweeter T2 disposed in the left and right of the speaker unit 10B.

When the AM amplifier 31 is used, the speaker unit 10B may be used as a center speaker because the user makes external speakers available. Therefore, the controller 108*a* controls the mute unit 108*c* to mute the stereo audio signal. The controller 108*a* further controls the selector 108*d* to select the monaural audio signal. By the aforementioned control, monaural audio is output from a combination of the tweeter T3 and the woofers W1 and W2 disposed in the center portion of the speaker unit 10B. In this case, audio is output also from the speakers 21 to 24 which are external speakers (because the audio signal is fed from the AV amplifier 31 to the speakers 21 to 24 which are external speakers).

The signal receiver 111 receives a remote control signal which is transmitted from the remote controller 112 by radio such as infrared rays. The remote controller 112 is provided with various keys for operating the audio output device 10, such as a "select" key, a "select" key, etc. The user can operate the AV amplifier 31 and the storage/reproducing device 41 by using the remote controller 112.

Figure 4:
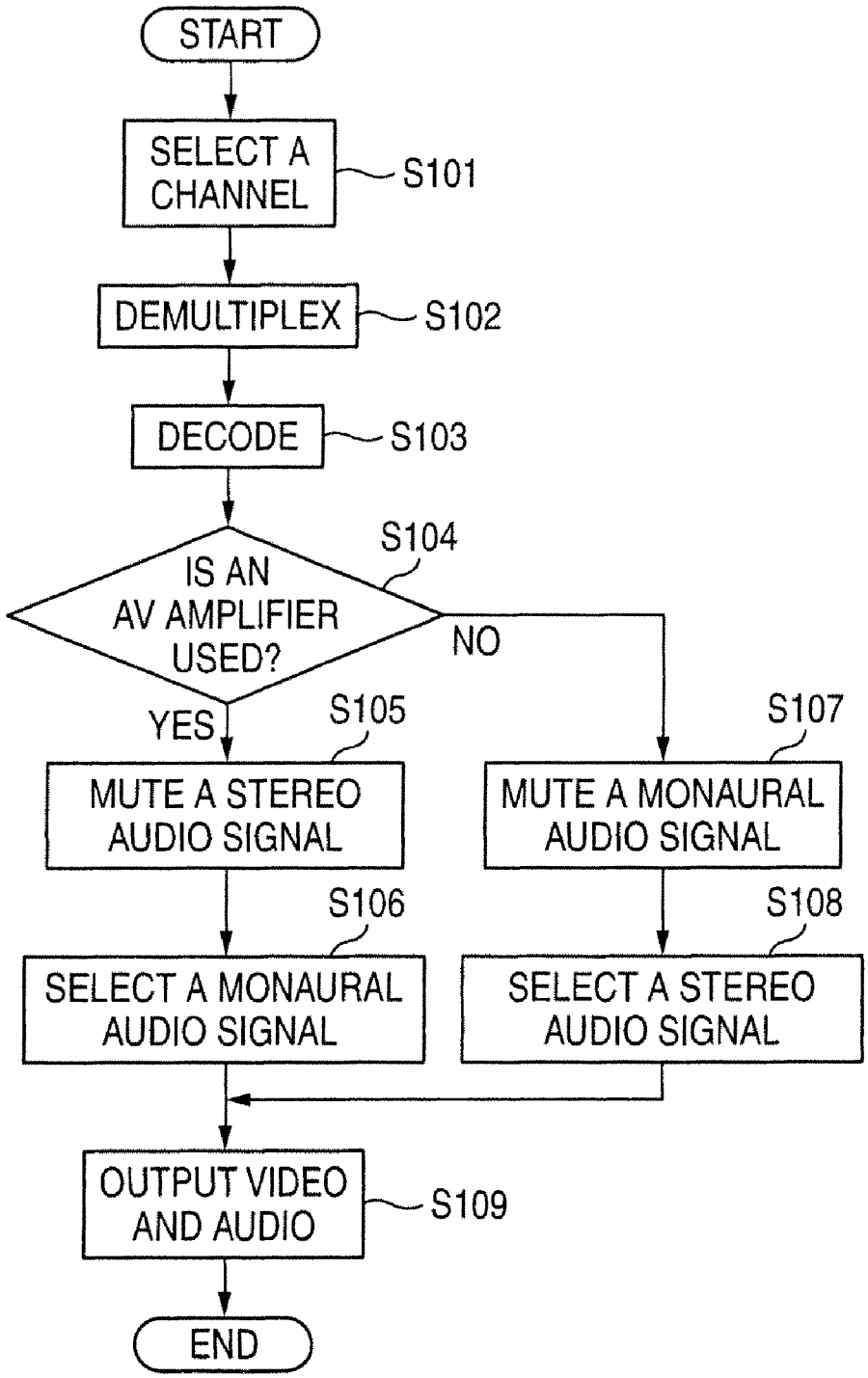
FIG. 4 is an exemplary flow chart showing an operation of an audio output device according to the first embodiment.

Next, the operation of the acoustic system 1 according to the first embodiment will be described. FIG. 4 is an exemplary flow chart showing the operation of the acoustic system 1 according to the first embodiment. The channel selector 101 selects a desired channel from a broadcast signal received via the antenna (Step S101). The channel selector 101 generates a TS (Transport Stream) by demodulating the broadcast signal of the selected channel.

The demultiplexer 106 demultiplexes a broadcast signal, PI/PSI, etc. from the TS generated by the channel selector 101 (Step S102). The decoder 107 generates an audio signal and a video signal by decoding an audio ES and a video ES demultiplexed by the demultiplexer 106 (Step S103). The demultiplexer 106 inputs the generated audio signal to the audio signal processor 108. The demultiplexer 106 further inputs the generated video signal to the display unit 10C.

The controller 108*a* of the audio signal processor 108 determines whether the AV amplifier 31 is used or not (Step S104). When the AV amplifier 31 is used (Yes in Step S104), the controller 108*a* controls the mute unit 108*c* to mute a stereo audio signal (Step S105). The controller 108*a* further controls the selector 108*d* to select a monaural audio signal (Step S106).

When the AV amplifier 31 is not used (No in Step S104), the controller 108*a* controls the mute unit 108*b* to mute a monaural audio signal (Step S107). The controller 108*a* further controls the selector 108*d* to select a stereo audio signal (Step S108). The display unit 10C and the speaker unit 10B output video and audio in accordance with the input video and audio signals (Step S109). Although the aforementioned description has been made in the case where a channel is selected from a broadcast signal, processing will start at Step S104 when contents etc. reproduced by the storage/reproducing device 41 are viewed.

Figure 5:
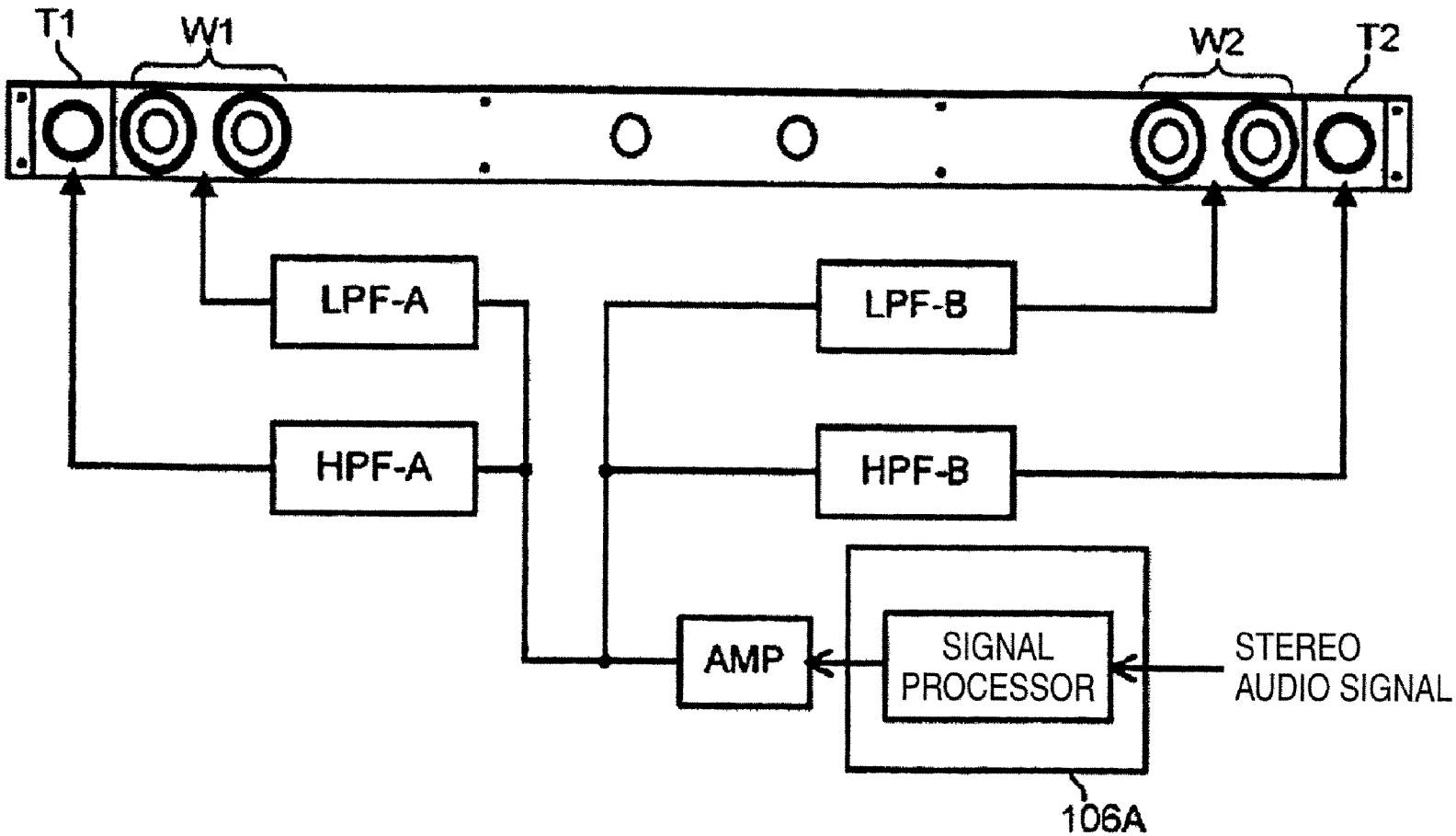
FIG. 5 is an exemplary diagram showing a configuration of an audio signal processing system according to a comparative example.

FIG. 5 is an exemplary diagram showing the configuration of an audio signal processing system according to a comparative example. As shown in FIG. 5, in the comparative example, an audio signal to be input to speakers (tweeters T1 and T2 and woofers W1 and W2 in FIG. 5) is amplified by one common amplifier AMP. The audio signal amplified by the amplifier AMP is branched in accordance with the speakers. The branched audio signals are input to the tweeters T1 and T2 and the woofers W1 and W2 through high pass filters HPF-A and HPF-B and low pass filters LPF-A and LPF-B, respectively.

Each of the high pass filters HPF-A and HPF-B and the low pass filters LPF-A and LPF-B is an analog filter composed of a combination of a coil L and a capacitor C. Each of the high pass filters HPF-A and HPF-B separates and passes a treble component of an input audio signal. Each of the low pass filters LPF-A and LPF-B separates and passes a bass component of the input audio signal.

That is, in the comparison example, the output of the amplifier AMP is separated into bands in accordance with the speakers by an LC network (the LPF-A, the LPF-B, the HPF-A and the HPF-B in FIG. 5) configured by combinations of coils L and capacitors C disposed in the inside or vicinity of the speakers. Specifically, the audio signal is separated into a treble audio signal and a bass audio signal by the LC network, so that the treble audio signal separated from the audio signal is input to the tweeters T1 and T2 while the bass audio signal is input to the woofers W1 and W2.

A phase disturbance caused by the capacitor C or the coil L occurs in the vicinity of a cutoff frequency (an edge of the band separated by the network) when an audio single is separated into a treble band or a bass band by a high pass filter or a low pass filter. As a method of reducing the phase disturbance, there is a multi-amplifier method in which an audio signal is amplified by amplifiers provided individually in accordance with the speakers. However, even when the multi-amplifier method is used, rounding occurs in transient characteristic (rising edge characteristic) of a composite waveform if Linkwitz-Riley type filters represented by FIR (Finite Impulse Response) filters are applied to separation of an audio signal.

Figure 6A:
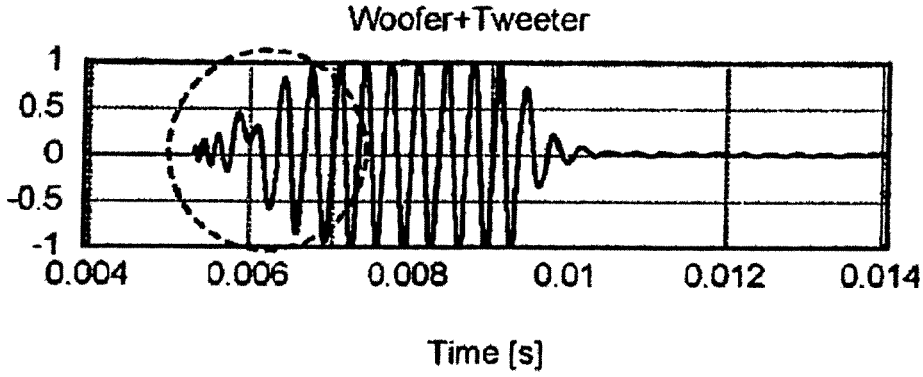
FIG. 6A is an exemplary graph showing transient characteristic according to the comparative example.
Figure 6B:
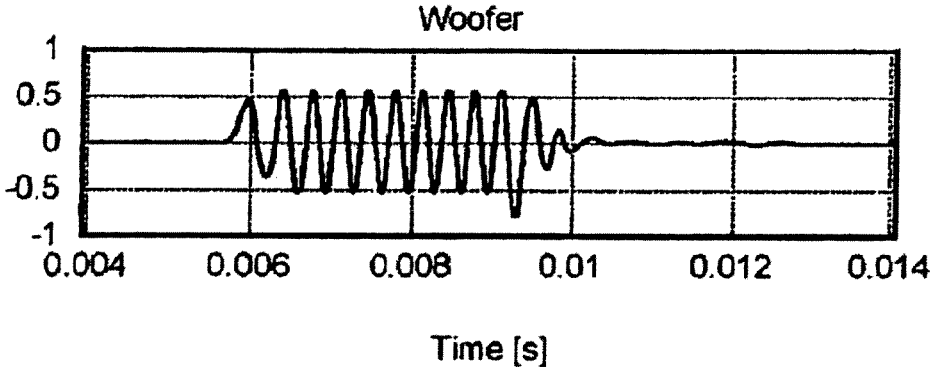
FIG. 6B is an exemplary graph showing transient characteristic according to the comparative example.
Figure 6C:
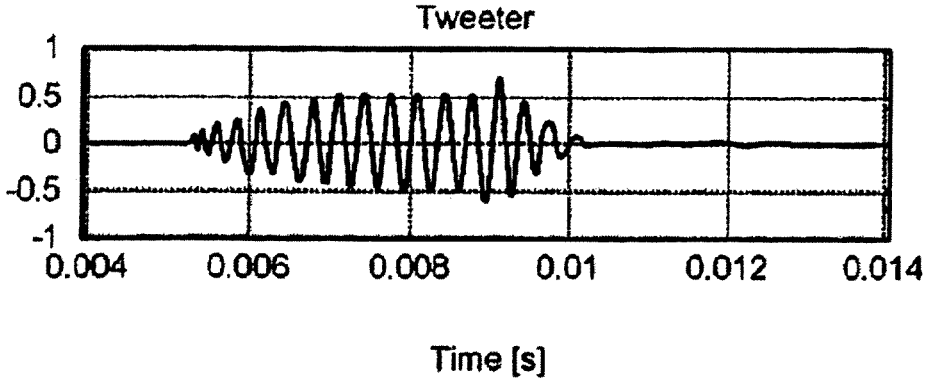
FIG. 6C is an exemplary graph showing transient characteristic according to the comparative example.

FIGS. 6A to 6C are exemplary graphs showing transient characteristic in the case where the Linkwitz-Riley type filters are used. FIG. 6A is an exemplary graph showing a woofer-tweeter composite waveform. FIG. 6B is an exemplary graph showing a woofer waveform. FIG. 6C is an exemplary graph showing a tweeter waveform. When the Linkwitz-Riley type filters are used, rounding occurs in the rising edges of both the woofer waveform and the tweeter waveform as shown in FIGS. 6B and 6C. For this reason, as shown in FIG. 6A, rounding occurs also in the rising edge (a portion encircled by the broken line) of the woofer-tweeter composite waveform.

On the other hand, the audio output device 10 according to the first embodiment uses linear-phase filters as the HPFs and the LPFs. Accordingly, it is possible to effectively suppress occurrence of rounding in the transient characteristic (rinsing-edge characteristic) of the composite waveform.

Figure 7A:
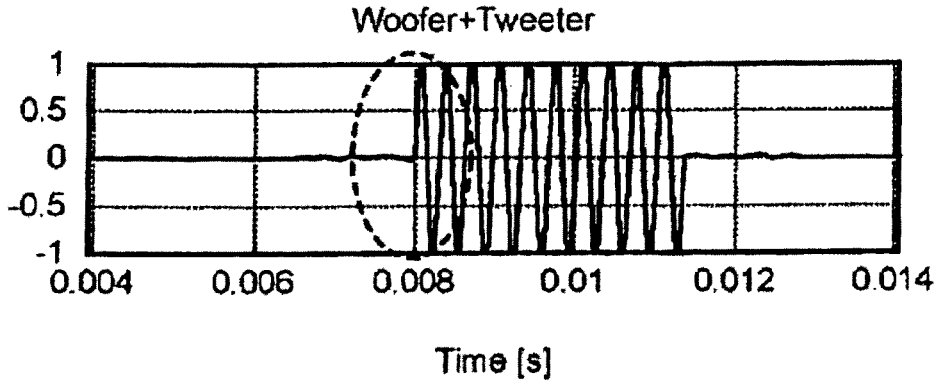
FIG. 7A is an exemplary graph showing transient characteristic according to the first embodiment.
Figure 7B:
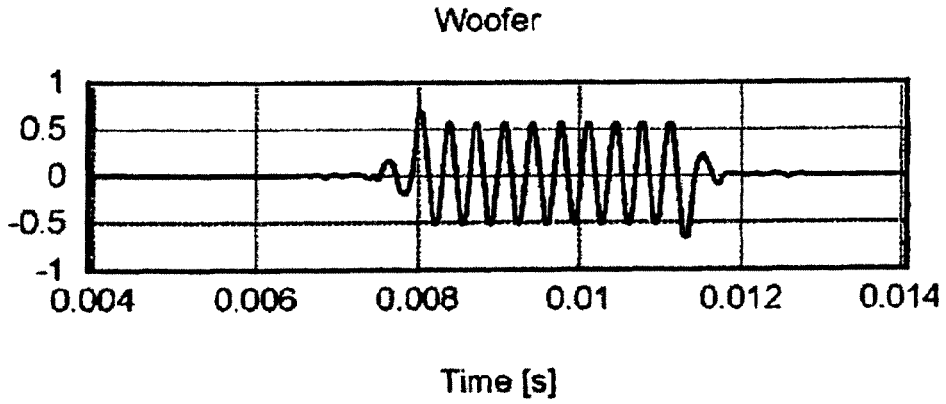
FIG. 7B is an exemplary graph showing transient characteristic according to the first embodiment.
Figure 7C:
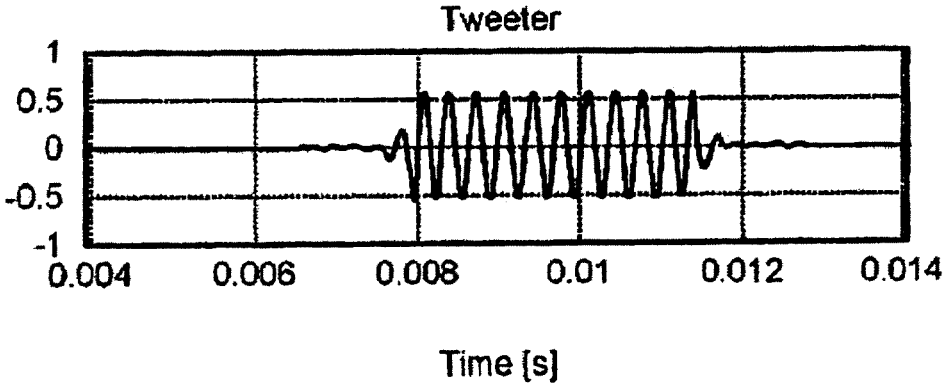
FIG. 7C is an exemplary graph showing transient characteristic according to the first embodiment.

FIGS. 7A to 7C are exemplary graphs showing transient characteristic in the case where the linear-phase filters are used. FIG. 7A is an exemplary graph showing a woofer-tweeter composite waveform. FIG. 7B is an exemplary graph showing a woofer waveform. FIG. 7C is an exemplary graph showing a tweeter waveform. As shown in FIGS. 7B and 7C, it is possible to suppress effectively occurrence of rounding in the rinsing edges of both the woofer waveform and the tweeter waveform. Accordingly, as shown in FIG. 7A, it is possible to suppress effectively occurrence of rounding also in the rising edge (a portion encircled by the broken line) of the woofer-tweeter composite waveform.

The number of FIR taps may be increased in order to obtain sufficient cutoff characteristic (attenuation characteristic). It is however possible to configure an FIR filter having an enough number of taps to achieve sufficient cutoff characteristic (attenuation characteristic) because performance of a digital device such as a DSP for audio has been improved recently. Accordingly, the linear-phase filter can be used as a channel divider.

As described above, the audio output device 10 according to the first embodiment is provided with the speaker unit 10B in which the tweeter T3 is disposed between a combination of the woofers W1 and the tweeter T1 and a combination of the woofers W2 and the tweeter T2 which are provided for reproduction of stereo audio and disposed on the left and right of the integrally formed speaker box, respectively. When the external speakers 21 to 24 are available, input of a stereo audio signal to the tweeters T1 and T2 is stopped so that a monaural audio signal fed from the AV amplifier 31 is input to the woofers W1 and W2 and the tweeter T3. That is, when the external speakers 21 to 24 are available, a combination of the woofers W1 and W2 and the tweeter T3 serves as a center speaker to form a 5.1-channel acoustic system.

For this reason, the center speaker is disposed in front of the user to thereby improve sound location. Moreover, because the tweeter T3 which is a treble speaker is disposed in the center between combinations of the woofers W1 and W2, characteristic of monaural audio can be obtained more effectively to improve sound localization when the speaker unit 10B serves as a center speaker (for outputting monaural audio). Moreover, because the tweeters T1 and T2 which are treble speakers are disposed in the opposite ends of the speaker unit 10B, a sensation of separation into left and right to create stereo characteristic can be improved to obtain the characteristic more effectively when the tweeters T1 and T2 serve as ordinary speakers (for outputting stereo audio). In this manner, both design and functionality of the audio output device 10 can be improved without any disturbance of user's viewing, so that the problem of coexistence with the speakers of the AV device can be solved.

Moreover, in the first embodiment, the audio signal processor 108 is composed of a DSP in which linear-phase filters are used as the high pass filters HPFs 108*f* and 108*g* and the low pass filter LPF 108*h*. Accordingly, it is possible to effectively suppress occurrence of rounding in the transient characteristic (rising-edge characteristic) of the composite waveform. Although the LC network forming analog filters is limited to −18 dB/oct at maximum, cutoff characteristic can be set precipitously as described with reference to FIGS. 6A to 7C when the filters of the audio signal processor 108 according to the first embodiment are used.

For this reason, it is possible to reduce mutual interference in the vicinity of cutoff frequencies of the respective speakers. Particularly, in the tweeters which may be damaged when a bass audio signal is input to the tweeters, the allowed audio band can be widened (the cutoff frequency can be set to be low) because cutoff characteristic of the audio signal can be secured sufficiently. In addition, undulation of the phase (rotation of the phase) generally increases in the vicinity of cutoff frequencies when the cutoff characteristic (attenuation characteristic) is increased. For this reason, there is a tendency that connection between sounds of the respective speakers is worsened in the vicinity of cutoff frequencies. In the first embodiment, it is however possible to suppress sudden rotation of the phase (change of the phase) in the vicinity of cutoff frequencies because the linear-phase filters are used. Accordingly, it is possible to effectively improve connection of sounds between the respective speakers.

The invention is not limited to the embodiment per se and constituent elements can be modified and put into practice without departing from the scope of the invention in a practical stage. Although the first embodiment has been described about a 5.1-channel acoustic system by way of example, the invention can be applied to any acoustic system as long as the acoustic system uses a center speaker. Although FIG. 1 shows the configuration in which the storage/reproducing device 41 is connected to the audio output device 10, configuration may be made so that the storage/reproducing device 41 is connected to the AV amplifier 31.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the devices and systems described herein may be made without departing from the spirit of the inventions. The accompanying claims and their equivalents are intended to cover such forms or modifications as would fall within the scope and spirit of the inventions.

What is claimed is:

1. An audio output device comprising:

a speaker unit including a plurality of speakers, including at least a first speaker, a second speaker, a third speaker, a fourth speaker and a fifth speaker; and an audio signal processor configured to select a first mode for outputting a stereo audio signal from the first speaker, the second speaker, the fourth speaker and the fifth speaker when an external speaker is not used, and configured to select a second mode for outputting a monaural audio signal from the third speaker, the fourth speaker and the fifth speaker when the external speaker is used.

2. The audio output device according to claim 1, wherein:

each of the first and second speakers outputting a treble component of the stereo audio signal; and the third speaker comprises a speaker for outputting a treble component of the monaural audio signal.

3. The audio output device according to claim 2, wherein:

the first and second speakers output the treble component and the fourth and fifth speakers output the bass component to produce the stereo audio signal in the first mode; and the third speaker outputs the treble component and the fourth and fifth speakers output the bass component to produce the monaural audio signal in the second mode.

4. The audio output device according to claim 1, wherein the third speaker outputs the treble component of the monaural audio signal, and the fourth and fifth speakers output the bass component of the monaural audio signal in the second mode.

5. The audio output device according to claim 1, wherein the audio signal processor comprises:

a selector configured to select either one of the stereo audio signal and the monaural audio signal;

a first mute unit configured to mute the monaural audio signal;

a second mute unit configured to mute the stereo audio signal; and a controller configured to control the selector to select the monaural audio signal and control the second mute unit to mute the stereo audio signal when the external speaker is used, and to control the selector to select the stereo audio signal and control the first mute unit to mute the monaural audio signal when the external speaker is not used.

6. The audio output device according to claim 5, wherein the audio signal processor further includes:

a first filter provided in a rear stage of the first mute unit to pass a treble component of the monaural audio signal;

a second filter provided in a rear stage of the second mute unit to pass a treble component of the stereo audio signal; and a third filter provided in a rear stage of the selector to pass a bass component of either of the stereo audio signal and the monaural audio signal selected by the selector.

7. The audio output device according to claim 1, further comprising a setting unit configured to set an usage status of the external speaker, wherein the audio signal processor selects either one of the first mode and the second mode based on the usage status set by the setting unit.

8. The audio output device according to claim 1 wherein the audio signal processor selects either one of the first mode and the second mode based on a detection signal for detecting an usage status of the external speaker.

9. An audio output method for an acoustic system including an external speaker and a speaker unit that comprises a first speaker, a second speaker, a third speaker, a fourth speaker and a fifth speaker, the method comprising:

detecting an usage status of the external speaker; and selecting, by a controller within the speaker unit, a first mode for outputting a stereo audio signal from the first and second speakers and the fourth and fifth speakers when an external speaker is not used, and selecting, by the controller, a second mode for outputting a monaural audio signal from the third speaker and the first and second speaker when the external speaker is used.

10. The audio output method according to claim 9, wherein the first and second speakers output the bass component of the monaural audio signal in the second mode.

* * * * *